US010519019B2

(12) United States Patent
Kuo

(10) Patent No.: US 10,519,019 B2
(45) Date of Patent: Dec. 31, 2019

(54) RADIATOR FUNNEL ASSEMBLY WITH UNIQUE IDENTIFIERS

(71) Applicant: EP Family Corp., Walnut, CA (US)

(72) Inventor: Hung-Chih Kuo, Walnut, CA (US)

( * ) Notice: Subject to any disclaimer, the term of this patent is extended or adjusted under 35 U.S.C. 154(b) by 61 days.

(21) Appl. No.: 15/368,441

(22) Filed: Dec. 2, 2016

(65) Prior Publication Data

US 2018/0155175 A1 Jun. 7, 2018

(51) Int. Cl.
*B67C 11/02* (2006.01)
*B67C 11/00* (2006.01)

(52) U.S. Cl.
CPC ..... *B67C 11/02* (2013.01); *B67C 2011/20* (2013.01)

(58) Field of Classification Search
CPC .. B67C 11/02; B67C 2011/12; B67C 2011/20
USPC ..... 141/340, 334, 331, 332, 333
See application file for complete search history.

(56) References Cited

U.S. PATENT DOCUMENTS 142,917 A * 9/1873 Johnson ..... B65D 88/54 220/86.1
853,756 A * 5/1907 Betis ..... G09B 1/20 434/402
1,233,352 A * 7/1917 Helcher ..... B67C 11/04 111/95
1,606,342 A * 11/1926 Bruce ..... F16N 31/002 137/234.6
1,695,053 A * 12/1928 Milligan ..... B67C 11/02 137/557
2,399,300 A * 4/1946 Stewart ..... B67C 3/16 137/205
2,531,288 A * 11/1950 Moore ..... F16L 27/12 137/547
2,721,561 A * 10/1955 Dyche ..... A45D 40/265 401/129
2,811,181 A * 10/1957 Correll ..... B67C 11/02 141/340
3,034,521 A * 5/1962 Greenfield ..... F01P 11/0214 134/102.1
3,177,907 A * 4/1965 Baldi ..... B67C 11/04 141/300
3,939,581 A * 2/1976 Clarke, Jr. ..... G09B 23/26 434/278

(Continued)

*Primary Examiner* — Timothy L Maust
*Assistant Examiner* — James R Hakomaki
(74) *Attorney, Agent, or Firm* — Tommy SF Wang; Wang IP Law Group, P.C.

(57) ABSTRACT

A radiator funnel assembly facilitates filling refrigerant liquids in different radiators. The assembly provides various sizes and types of adapters and caps, with each adapter and cap having a unique identifier to facilitate assemblage and indicate a matching radiator fill opening. The assembly includes a funnel configured to receive a radiator fluid and carries the radiator fluid through a spout. Multiple conduits detachably attach in series to the spout. Multiple adapters receive the conduits and engage a specific radiator fill opening. Each adapter has a unique identifier that enables identification of the connecting conduit, and also identifies the specific type of radiator fill opening that is operable with the adapter. Multiple caps fasten the adapters to the radiator opening. Each cap has a unique identifier to identify and match to the appropriate adapter. This is useful for matching the adapter and cap to different types of radiators.

9 Claims, 17 Drawing Sheets

(56) References Cited

U.S. PATENT DOCUMENTS 3,939,884 A * 2/1976 Mader ..... B67C 11/02 141/333
4,150,673 A * 4/1979 Watt ..... A61J 1/10 128/DIG. 24
4,338,983 A * 7/1982 Hatcher ..... B67C 11/02 141/331
4,634,017 A * 1/1987 Kilayko ..... F01P 11/0214 220/203.23
4,856,568 A * 8/1989 Murphy ..... B67C 11/00 141/337
4,901,776 A * 2/1990 Attinello ..... B67C 11/02 116/228
5,186,358 A * 2/1993 McVay ..... B67C 11/02 141/332
5,195,567 A * 3/1993 Tyree, Jr. ..... B67C 11/02 141/297
5,626,174 A * 5/1997 Schaffner ..... B67C 11/02 141/332
5,685,351 A * 11/1997 Kazarian ..... B65D 47/00 141/325
5,947,937 A * 9/1999 Urrutia ..... A61J 1/10 604/411
5,992,481 A * 11/1999 Smith ..... F01P 11/0204 141/300
6,510,876 B2 * 1/2003 Camacho ..... F01P 11/04 141/367
6,976,945 B1 * 12/2005 Lim ..... A63B 23/0211 482/148
7,198,080 B2 * 4/2007 Foust ..... B65D 71/502 141/319
7,992,600 B2 * 8/2011 Liu ..... F01P 11/0204 141/59
8,973,625 B2 * 3/2015 Liao ..... B65B 39/02 141/332
9,103,110 B1 * 8/2015 Gerber ..... E04B 1/3211
9,493,332 B2 * 11/2016 Kraft ..... B67C 11/02
2003/0220599 A1 * 11/2003 Lundtveit ..... A61M 1/28 604/5.01
2004/0133973 A1 * 7/2004 Rosenberg ..... A47K 3/28 4/601
2007/0181597 A1 * 8/2007 Raterman ..... B05C 11/10 222/23
2008/0174107 A1 * 7/2008 Jordan ..... G09F 3/00 285/18
2010/0203798 A1 * 8/2010 Beg ..... A63H 33/086 446/124
2012/0046738 A1 * 2/2012 Lau ..... A61F 2/2412 623/2.1
2014/0027004 A1 * 1/2014 Kuo ..... F16L 11/04 138/145
2014/0041757 A1 * 2/2014 Kassouni ..... B67C 11/00 141/337
2017/0018209 A1 * 1/2017 Walley, Jr. ..... G09F 3/0295

* cited by examiner

RADIATOR FUNNEL ASSEMBLY WITH UNIQUE IDENTIFIERS

FIELD OF THE INVENTION

The present invention relates generally to a radiator funnel assembly with unique identifiers. More so, the present invention relates to a radiator funnel assembly that facilitates the filling of coolants and antifreeze fluids in different types of radiators; whereby the assembly is assembled and disassembled through a color coded or labeling scheme to facilitate identification when assembling and when attaching to different types of radiator fill openings; whereby the assembly comprises a funnel that receives a radiator fluid; whereby multiple conduits detachably attach to the funnel in series; whereby a plurality of adapters, with each adapter having a unique identifier, couple to the conduits and to different types of radiator fill openings based on the unique identifier; whereby a plurality of caps, with each cap having a unique identifier, fastens an adapter with a matching identifier to the radiator fill opening.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Typically, a radiator is a heat exchangers used for cooling internal combustion engines, mainly in automobiles but also in piston-engine aircraft, railway locomotives, motorcycles, and stationary generating plants. Often, the radiator comprises a tank that receives radiator fluid through a radiator fill opening defined by a circular lip portion. The radiator fill opening generally has different sizes and dimensions that require different types of adapters and caps to attach a funnel thereto.

Typically, a funnels is used to facilitate the filling of fluids in all types of receptacles including putting oil in the engine blocks of vehicles and even putting coolants and antifreeze fluids in the radiators of vehicles. The conventional funnel has a generally conical-shaped body into which fluids as such are poured and a spout integrally extending therefrom, through which the fluids drain into containers. Often, a funnel can be used to fill radiator fluid into a radiator.

Other proposals have involved devices for refilling a radiator with radiator fluid. The problem with these funnel devices is that they do not provide a means for easy installation and matching with the appropriate radiator fill opening. Even though the above cited funneling devices meet some of the needs of the market, a radiator funnel assembly that facilitates the filling of coolants and antifreeze fluids in different types of radiators; whereby the assembly is assembled and disassembled through a color coded or labeling scheme to facilitate identification when assembling and when attaching to different types of radiator fill openings; whereby the assembly comprises a funnel that receives a radiator fluid; whereby multiple conduits detachably attach to the funnel in series; whereby a plurality of adapters, with each adapter having a unique identifier, couple to the conduits and to different types of radiator fill openings based on the unique identifier; whereby a plurality of caps, with each cap having a unique identifier, fastens an adapter with a matching identifier to the radiator fill opening, is still desired.

SUMMARY

Illustrative embodiments of the disclosure are generally directed to a radiator funnel assembly with unique identifiers. The radiator funnel assembly with unique identifiers, hereafter "assembly" serves to facilitate the filling of coolants and antifreeze fluids in different types of radiators. The assembly provides various sizes and types of adapters and caps, with each adapter and cap having a unique identifier to facilitate assemblage and indicate a matching radiator fill opening. The assemblage order and appropriate radiator fill opening is facilitated through visual inspection of the unique identifier for each adapter and cap.

The assembly is assembled and disassembled through a color coded or labeling scheme in which the components assemble and match to a specific radiator fill opening based on matching unique identifiers. The unique identifier may include, without limitation, a color, an alphanumeric indicia, a symbol, a pattern, and a texture.

In some embodiments, the assembly comprises a funnel that is shaped and dimensioned to receive a radiator fluid and carries the radiator fluid through a spout. Multiple conduits detachably attach in series to detachably attach to the spout.

The assembly further comprises a plurality of adapters that receive the conduits and engage the radiator fill opening. Each adapter has a unique identifier that enables identification of the appropriate conduit for attachment, and also identifies the type of radiator fill opening that is operable with the specific adapter.

The assembly further comprises a plurality of caps that are configured to fasten the adapters to the radiator fill opening. Each cap has a unique identifier that enables identification and matching of the appropriate adapter. In this manner, the adapter and cap for a specific radiator fill opening is utilized. This may be useful for matching the adapter and cap to different types of radiators.

In one aspect, the radiator funnel assembly with unique identifiers, comprises:

- a funnel defined by a fluid receiving body having a side wall and a tapered bottom wall, the funnel further defined by a spout integral to the bottom wall of the fluid receiving body and extending therefrom, the spout having an inlet end, an outlet end, and a channel extending through the spout which is tapered downward from the bottom wall of the fluid receiving body or an inlet end of the spout to an outlet end of the spout;
- a first conduit defined by a first top end and a first bottom end, the first top end configured to detachably attach to the outlet end of the spout;
- a second conduit defined by a second top end and a second bottom end, the second top end configured to detachably attach to the first bottom end of the first conduit;
- a third conduit defined by a third top end and a third bottom end, the third top end configured to detachably attach to the second bottom end;
- a plurality of adapters configured to detachably attach to the third conduit and a radiator fill opening,
- each adapter defined by at least one unique identifier for identifying a particular radiator fill opening at which the adapter is configured to detachably attach, whereby the plurality of adapters are configured to be operable with different types of radiators, each adapter having:

a tube defined by a tube top end and a tube bottom end, the tube top end configured to detachably attach to the third bottom end of the third conduit, the tube bottom end being configured to enable insertion into the radiator fill opening, the tube further defined by a tube wall having an inner surface and an outer surface, the tube having a bore therethrough, the bore being defined by the inner surface of the tube wall of the tube;

at least one annular sealing flange integral to the outer surface of the tube wall configured to hold and restrain a flexible seal, the flexible seal configured to fit about the tube bottom end and tightly abut against the at least one annular sealing flange; and a plurality of caps defined by a top cap face and a hole for receiving the tube, the plurality of caps comprising a pair of fastening flanges extending toward one another from opposite edges of the plurality of caps below the top cap face for securing the plurality of caps onto a circular lip portion defining the radiator fill opening, each cap defined by the at least one unique identifier for identifying a particular tube to receive through the hole, the unique identifier of each cap further configured to identify a particular radiator fill opening at which the adapter is configured to detachably attach.

In another aspect, the unique identifier includes at least one of the following: a color, an alphanumeric indicia, a symbol, a pattern, and a texture.

In another aspect, a first adapter has a unique identifier of a red color and a letter A.

In another aspect, a second adapter has a unique identifier of a green color and a letter B.

In another aspect, a third adapter has a unique identifier of a blue color and a letter C.

In another aspect, a fourth adapter has a unique identifier of a yellow color and a letter D.

In another aspect, the fourth adapter comprises two different types of tubes and two different types of annular sealing flanges.

In another aspect, the funnel, the first conduit, the second conduit, and the third conduit are orange.

In another aspect, the plurality of adapters are configured to be operable with different types of radiators.

In another aspect, the assembly is fabricated from at least one of the following: a polymer, a metal, aluminum, a metal alloy, and rubber.

In another aspect, the first conduit and the second conduit are configured to bend.

In another aspect, the second conduit is straight.

In another aspect, the ends of the conduits and the spout attach through a friction fit relationship.

In another aspect, the flexible seal comprises an O-ring.

In another aspect, the plurality of adapters are configured to enable insertion into the radiator fill opening to substantially prevent a fluid from leaking out of a radiator between the plurality of adapters and the radiator fill opening during the filling of the radiator with the fluid.

In another aspect, the fluid is a coolant or an anti-freeze composition.

One objective of the present invention is to prevent spillage of radiator fluid during the filling of the radiator with the radiator fluid.

Another objective is to provide color coded adapters to facilitate assembling the funnel, the conduits, the adapter, and the cap.

Another objective is to provide color coded adapters to facilitate matching with different types of radiator fill openings.

Another objective is to provide color coded adapters to enable quick assembling without having to sort through the components.

Yet another objective is to provide an inexpensive to manufacture radiator funnel assembly.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
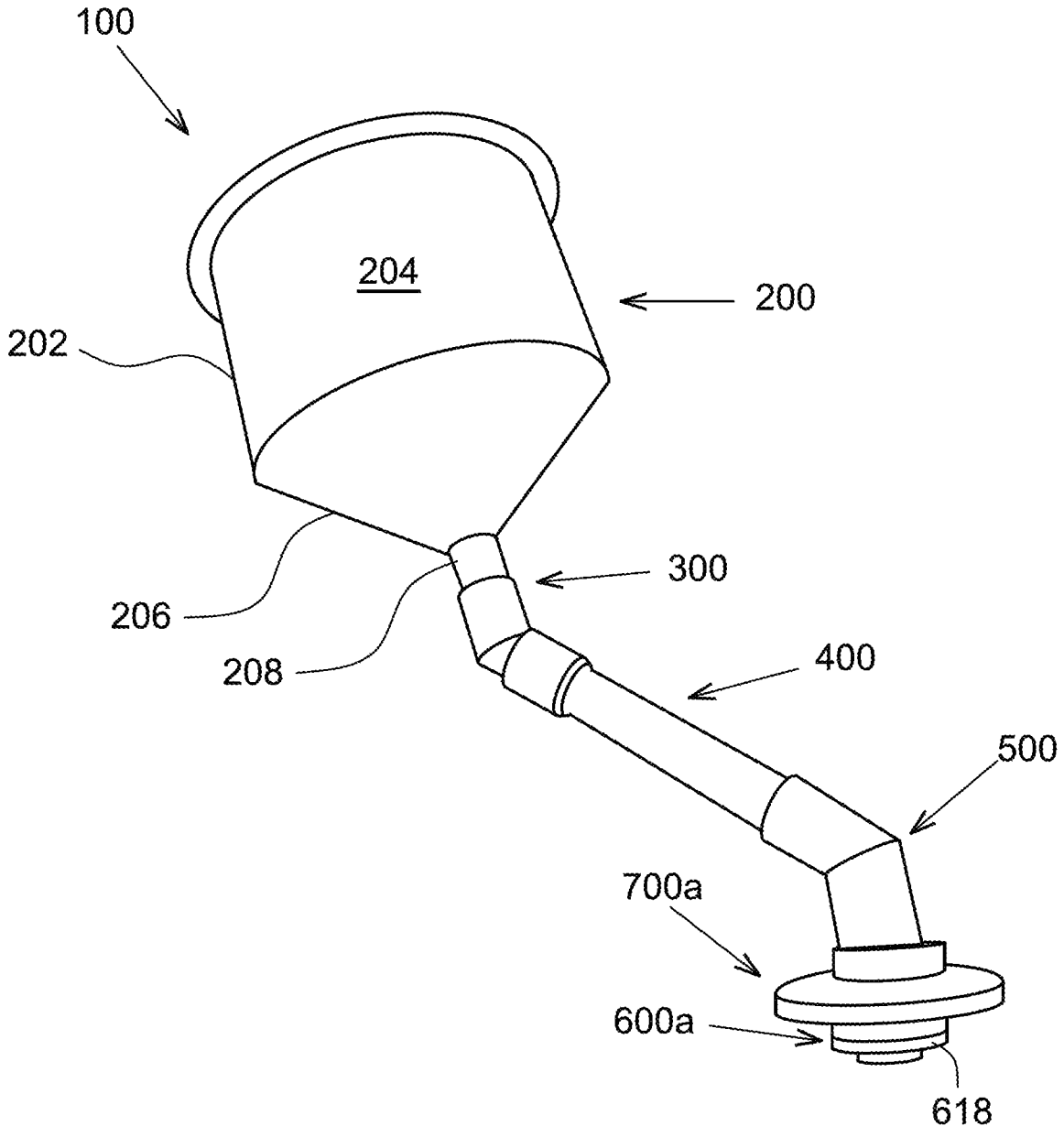
FIG. 1 illustrates a perspective view of an exemplary radiator funnel assembly with unique identifiers couplet with a radiate accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

A radiator funnel assembly 100 with unique identifiers is referenced in FIGS. 1-8. The radiator funnel assembly 100 with unique identifiers, hereafter "assembly 100" serves to facilitate the filling of coolants and antifreeze fluids in different types of radiators for various models and years of vehicles. The assembly 100 provides various sizes and types of adapters 600*a-e* and caps 700*a-d*, with each adapter 600*a*, 600*b*, 600*c*, 600*d*, 600*e* and cap 700*a*, 700*b*, 700*c*, 700*d* having at least one unique identifier 800*a-e* to facilitate assemblage and indicate a matching radiator fill opening 901*a-e*. Selection of the assemblage order and appropriate radiator fill opening is facilitated through visual inspection of the unique identifier 800*a-e* for each adapter 600*a-e* and cap 700*a-d*.

Those skilled in the art will recognize that a radiator is a heat exchangers used for cooling internal combustion engines, mainly in automobiles but also in piston-engine aircraft, railway locomotives, motorcycles, and stationary generating plants. Often, the radiator comprises a tank that receives radiator fluid through a radiator fill opening defined by a circular lip portion. The radiator fill opening generally has different sizes and dimensions that require different types of adapters 600*a-e* and caps 700*a-d* to attach a funnel 200 thereto.

In the present embodiment, the assembly 100 provides various sizes and types of adapters 600*a-e* and caps 700*a-d*, with each adapter 600*a* and cap 700*a* having a unique identifier 800*a*, 800*b*. The assemblage order and appropriate radiator fill openings 901*a* and 901*b* are facilitated through visual inspection of each unique identifier 800*a*, 800*b* for each adapter 600*a* and cap 700*a*.

In some embodiments, the assembly 100 may be assembled and disassembled through a color coded or labeling scheme in which the components assemble and match to a specific radiator fill opening based on matching unique identifiers 800*a-e*. The unique identifier 800*a-e* may include, without limitation, a color, an alphanumeric indicia, a symbol, a pattern, and a texture. Suitable materials for the assembly 100 may include, without limitation, a polymer, a metal, aluminum, a metal alloy, and rubber.

Looking at FIG. 1, the assembly 100 comprises a funnel 200 that is shaped and dimensioned to receive a radiator fluid and carries the radiator fluid through a spout 208, a series of conduits 300, 400, 500, and an adapter 600*a* before entering a radiator fill opening. The funnel 200 is defined by a fluid receiving body 202 having a side wall 204 and a tapered bottom wall 206. In one embodiment, the funnel 200 is conical in shape.

Figure 2:
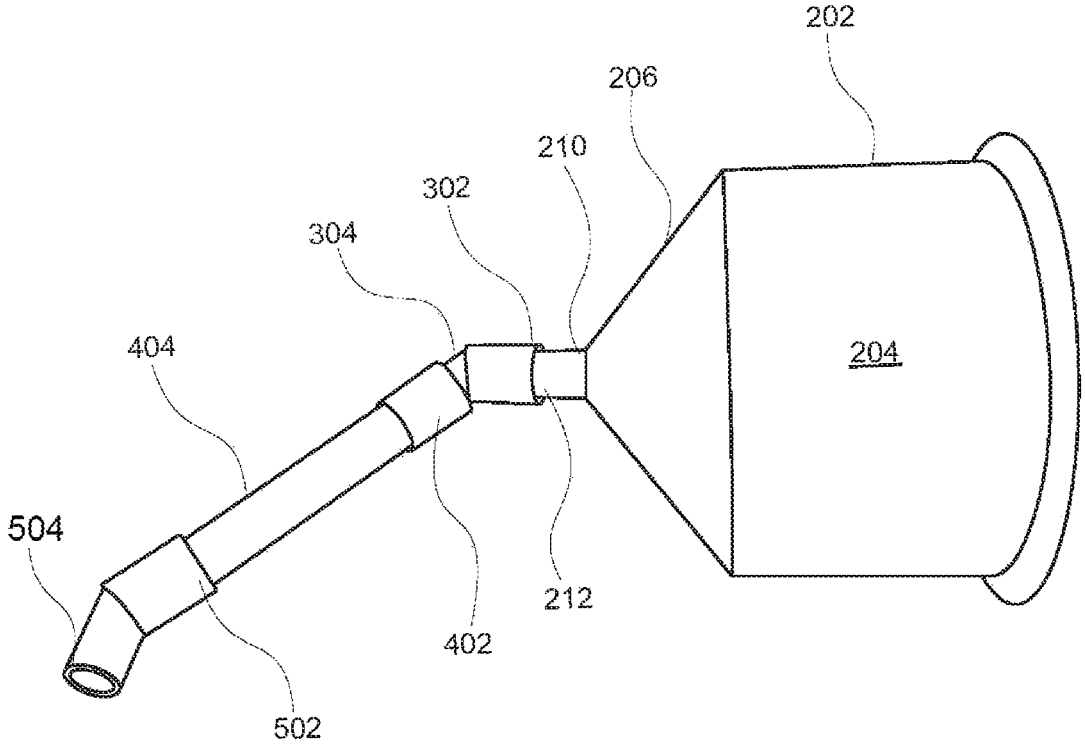
FIG. 2 illustrates a perspective view of an exemplary funnel joined with a series of conduits, in accordance with an embodiment of the present invention.

As shown in FIG. 2, the funnel 200 may also be defined by a spout 208 that is integral to the bottom wall 206 of the fluid receiving body 202 and extending therefrom. The spout 208 may include a generally narrow diameter. The spout 208 has an inlet end 210 integral with the funnel 200, an outlet end 212 for discharging radiator fluid, and a channel extending through the spout 208 which is tapered downward from the bottom wall 206 of the fluid receiving body 202, or an inlet end 210 of the spout 208 to an outlet end 212 of the spout 208.

Figure 3:
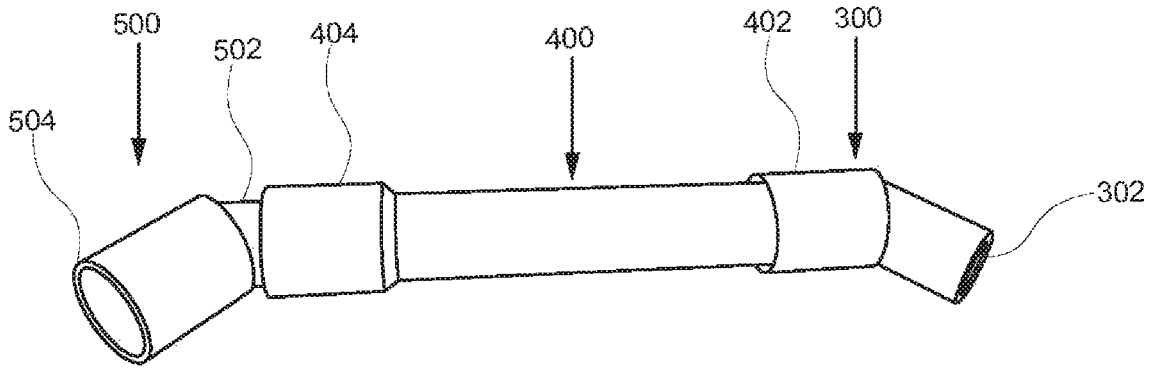
FIG. 3 illustrates a perspective view of an exemplary first conduit, a second conduit, and a third conduit joined together, in accordance with an embodiment of the present invention.

As referenced in FIG. 3, multiple conduits 300, 400, 500 detachably attach in series to detachably attach to the spout 208. A first conduit 300 is defined by a first top end 302 and a first bottom end 304. The first top end 302 is configured to detachably attach to the spout 208. Specifically, the first top end 302 is configured to detachably attach to the outlet end 212 of the spout 208 through a concentric, friction-fit relationship. The first conduit 300 is defined by at least one unique identifier 800*a* that matches the funnel 200. For example, the funnel 200 and the first conduit 300 may have an orange color.

A second conduit 400 is defined by a second top end 402 and a second bottom end 404. The second top end 402 is configured to detachably attach to the first bottom end 304 of the first conduit 300. The second conduit 400 is defined by a unique identifier 800*a-e* that matches the first conduit 300 and the funnel 200. For example, the second conduit 400 and the first conduit 300 may have an orange color.

A third conduit 500 is defined by a third top end 502 and a third bottom end 504. The third top end 502 is configured to detachably attach to the second bottom end 404. In one embodiment, this attachment is a friction fit relationship. In this manner, the three conduits attach in series from the spout 208 of the funnel 200 to the adapter. However in other embodiments, more or less than three conduits may be used for this function.

The third conduit 500 is defined by at least one unique identifier 800*a-e* that matches the first conduit 300, the second conduit 400, and the funnel 200. For example, the third conduit 500, the first conduit 300, the second conduit 400, and the funnel 200 may have an orange color. Though other colors or alphanumeric indicia may be used. In some embodiments, the first and third conduit 500*s* have a bend. The second conduit 400 may be straight.

Figure 4:
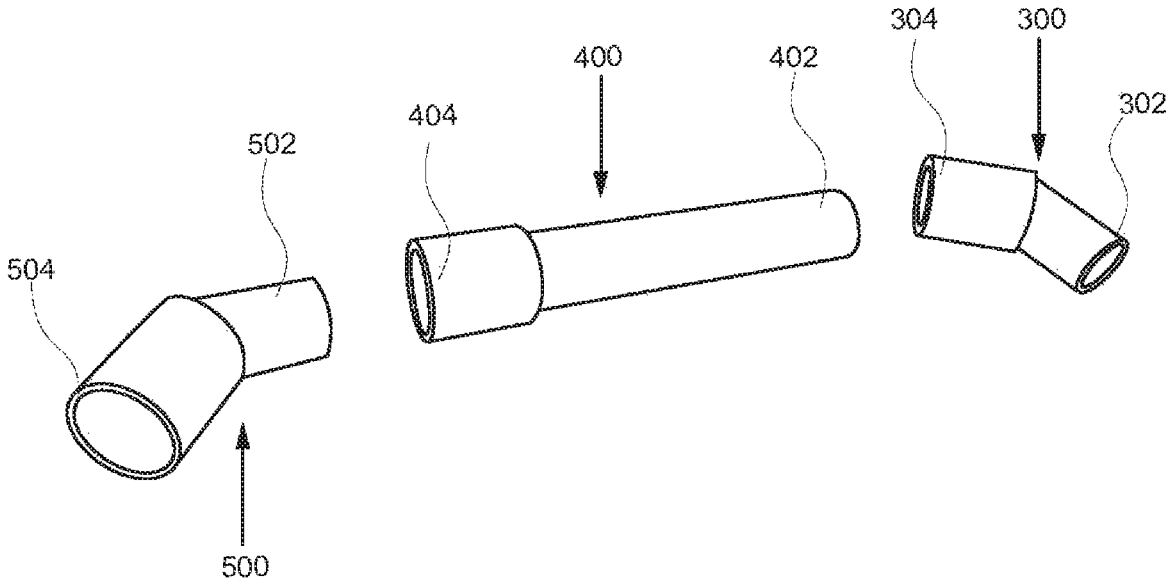
FIG. 4 illustrates a perspective view of an exemplary first conduit, a second conduit, and a third conduit separated, in accordance with an embodiment of the present invention.
Figure 5A:
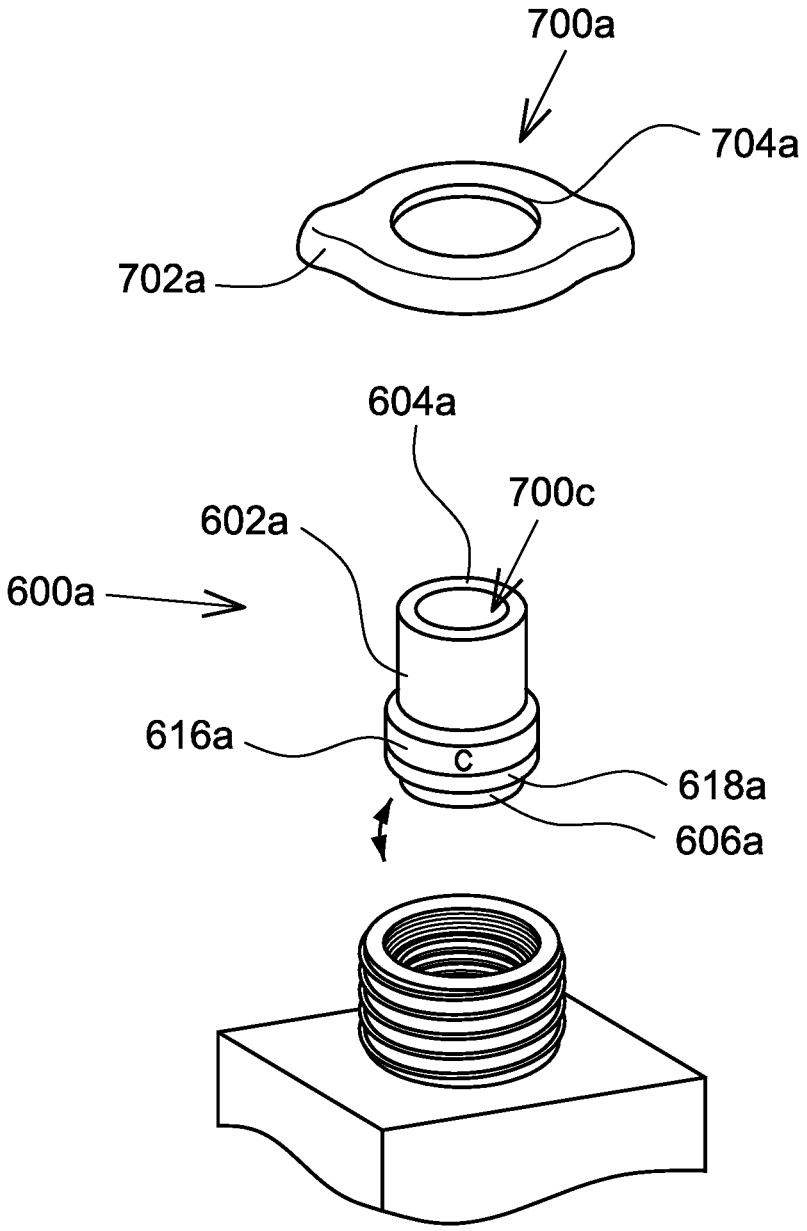
FIGS. 5A-5E illustrate perspective views of exemplary adapters, caps, and matching different types of radiators separated, in accordance with an embodiment of the present invention.
Figure 5B:
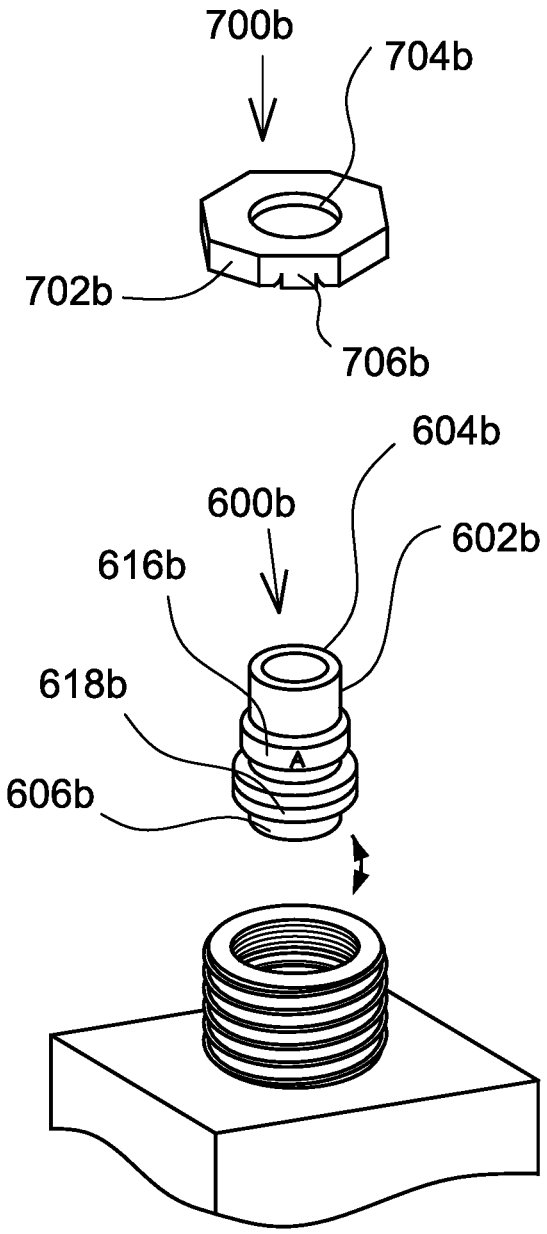
Figure 5C:
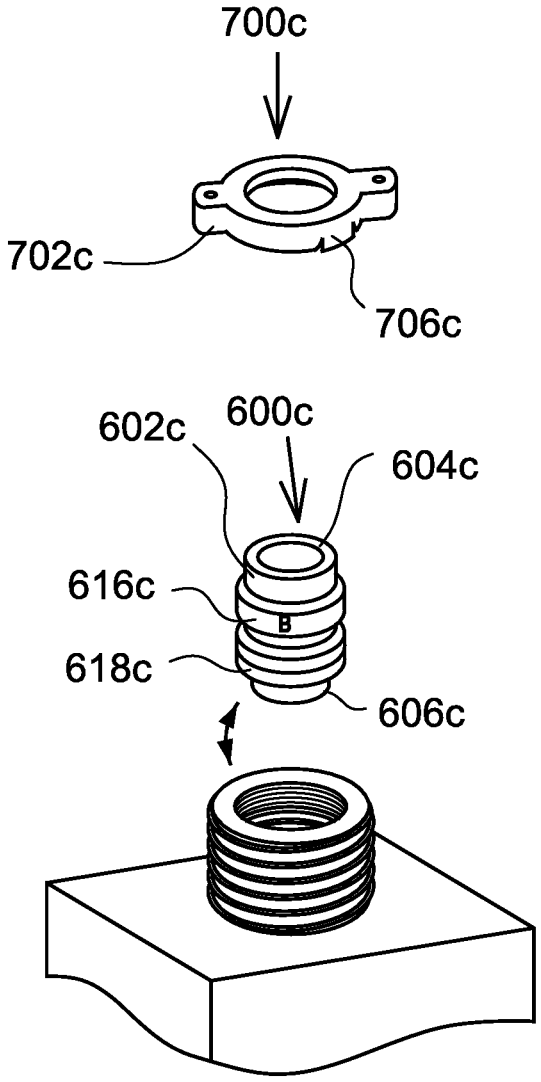
Figure 5D:
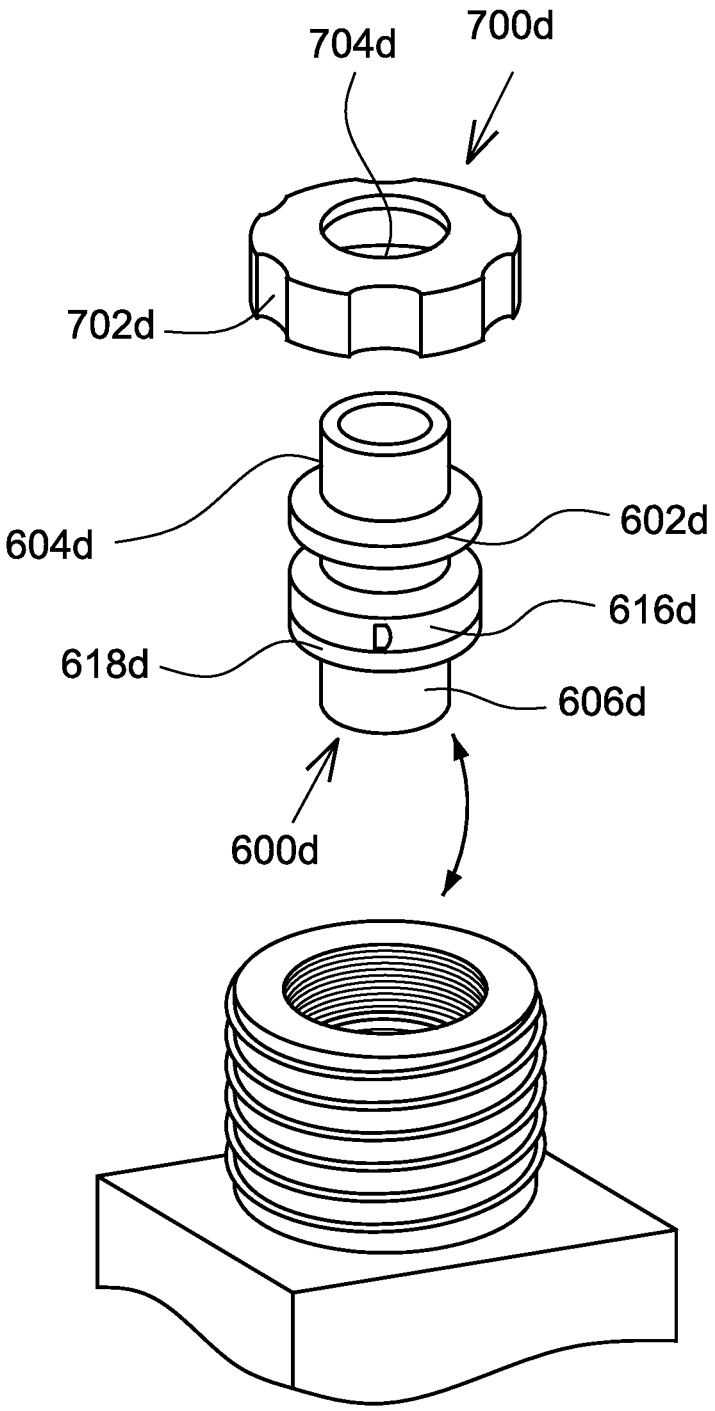
Figure 5E:
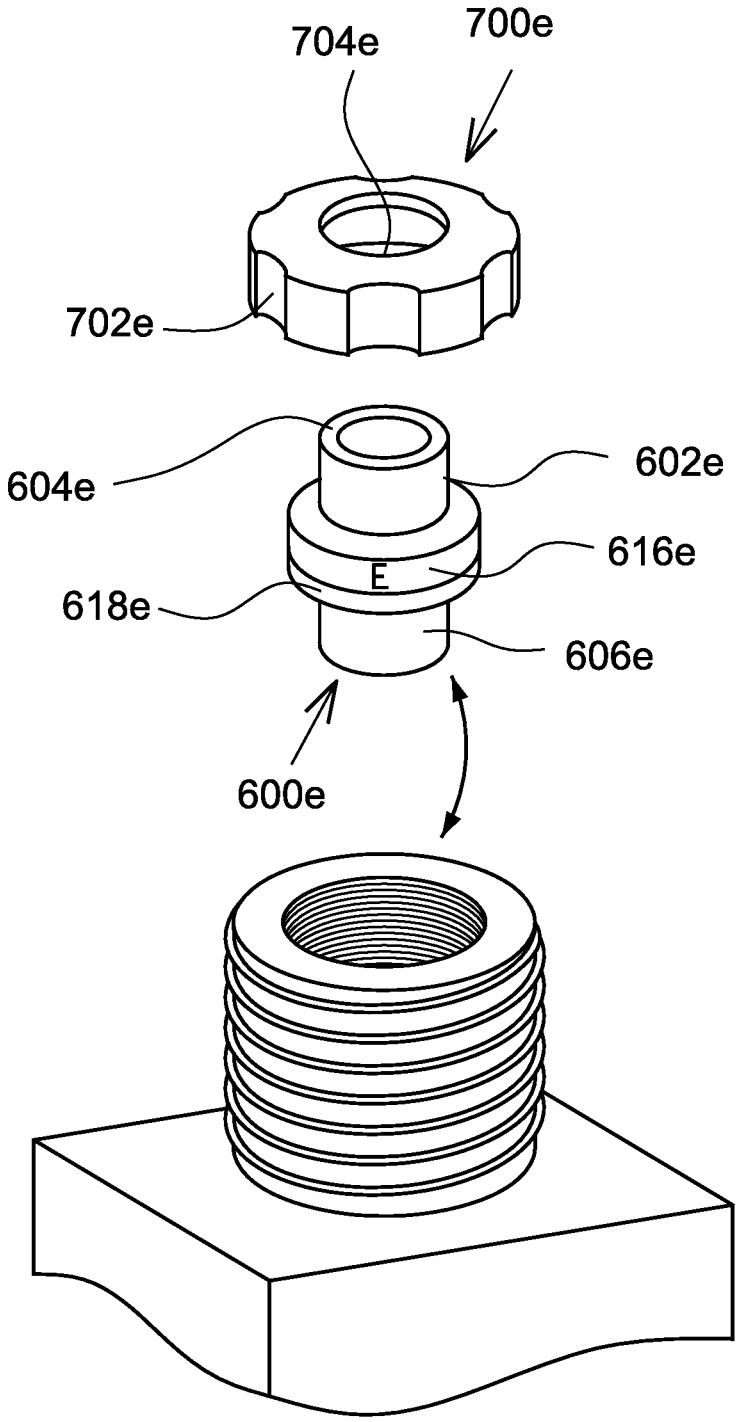
Figure 6A:
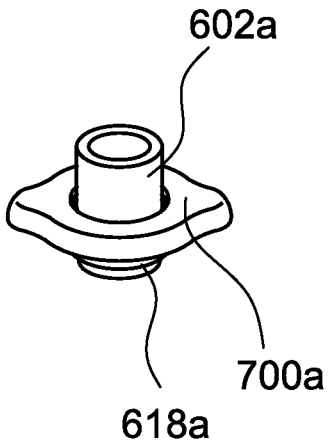
FIGS. 6A-6D illustrate perspective views of exemplary adapters and caps joined in an operational position, in accordance with an embodiment of the present invention.
Figure 6B:
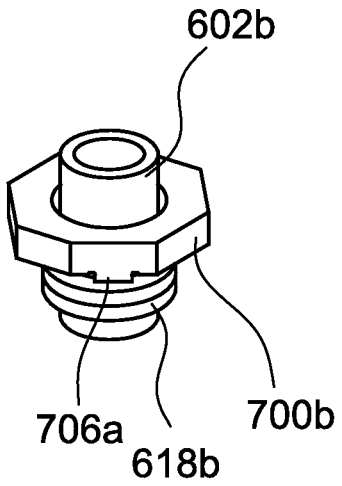
Figure 6C:
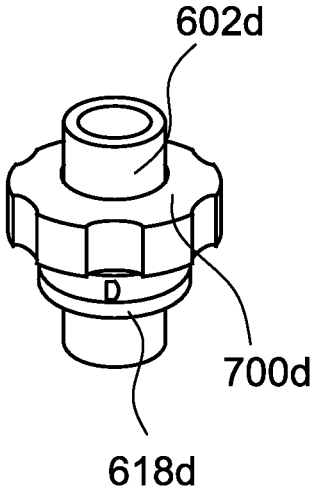
Figure 6D:
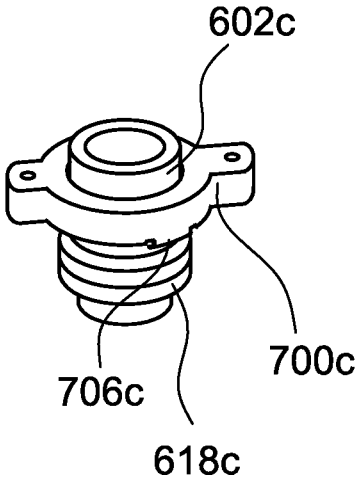
Figure 6E:
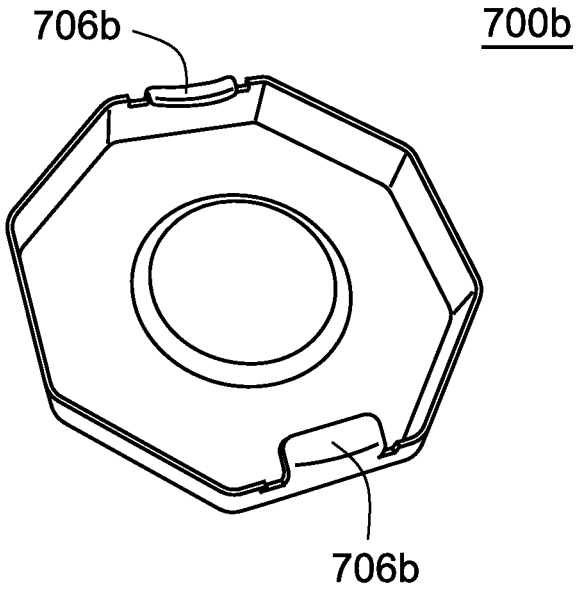
Figure 6F:
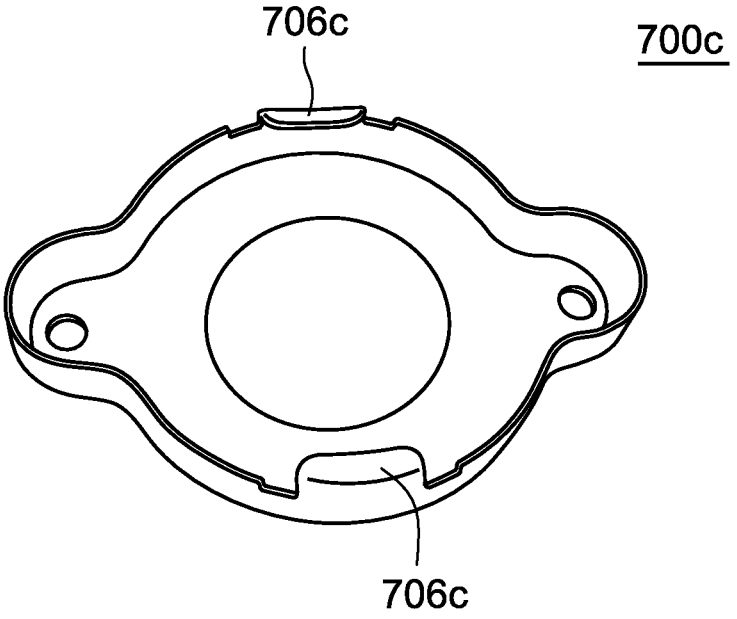

FIG. 4 illustrates the three conduits separated. The conduits are easily connected and separated through a friction fit relationship. Though in other embodiments, other fastening methods may be used.

Turning now to FIG. 5, the assembly 100 further comprises a plurality of adapters 600*a-e*. The adapter 600*a* receives the third bottom end 504 of the third conduit 500 from one end and engage the radiator fill opening 901*a* from an opposite end. Specifically, the adapter 600*a* is configured to enable insertion into the radiator fill opening 901*a* to substantially prevent fluid from leaking out of a radiator 900*a* between the adapter 600*a* and the radiator fill opening 901*a* during the filling of the radiator 900*a* with the fluid.

Turning to FIG. 6, the adapters 600*a-e* may include a tube 602*a-e* defined by a rube top end 604*a-e* and a tube bottom end 606*a-e*. The tube top end 604*a-e* is configured to detachably attach to the third bottom end 504 of the third conduit 500. The tube bottom end 606*a-e* is configured to enable insertion into the radiator fill opening. The tube 602*a-e* may also be defined by a tube wall 608 having an inner surface 612 and an outer surface 610. In some embodiments, the tube 602*a-e* has a bore 614 therethrough. The bore 614 is defined by the inner Surface 612 of the tube wall 608 of the tube 602*a-e*.

In addition to the tube 602*a-e*, the adapters 600*a-e* may include at least one annular sealing flange 616*a-e*. The sealing flange 616*a* helps insure a secure fit for the third conduit 500, so as to minimize leakage. The annular sealing flange 616*a* is integral to the outer surface 610 of the tube wall 608 and configured to hold and restrain a flexible seal 618*a-e*. The flexible seal 618*a* configured to fit about the tube bottom end 606*a* and tightly abut against the at least one annular sealing flange 616*a*. In one embodiment, the flexible seal 618*a* is a rubber O-ring.

Figure 7:
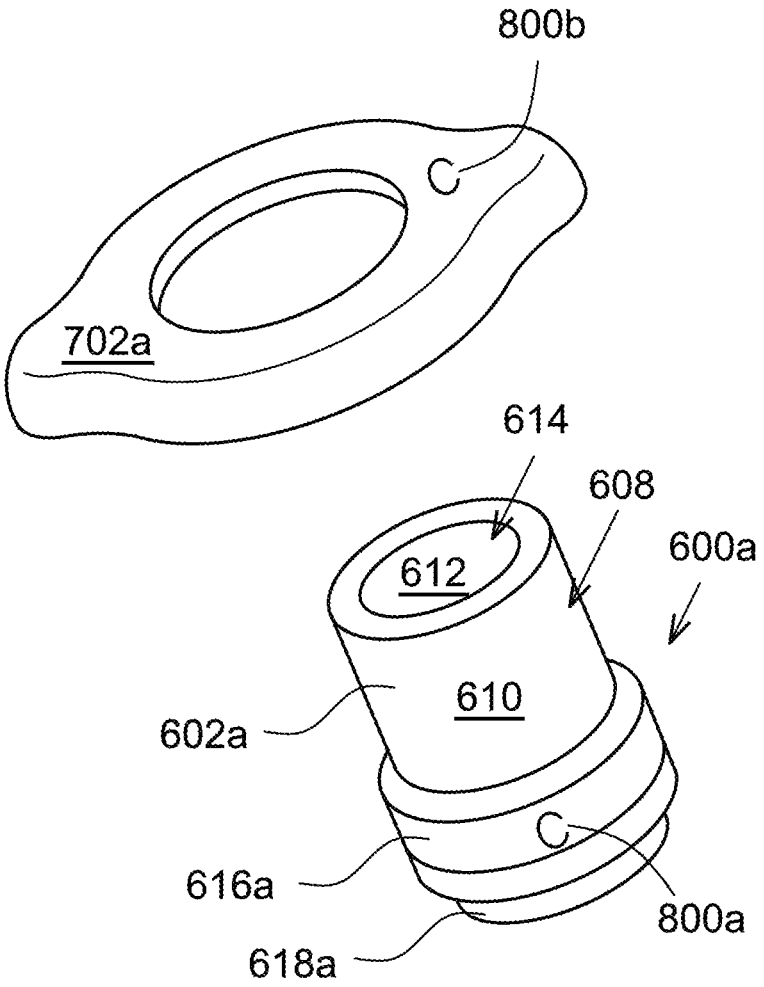
FIG. 7 illustrates a close up view of exemplary first adapter and a first cap, in accordance with an embodiment of the present invention.

FIG. 7 illustrates a close up view of exemplary adapter 600*a* and a cap 700*a* that is operational with adapter 600*a* and a specific radiator fill opening. The adapter 600*a* has at least one unique identifier 800*a* that enables identification of the appropriate conduit 500 for attachment, and also identifies the type of radiator fill opening at which the adapter 600*a* is configured to detachably attach. In this manner, the adapters 600*a-e* is configured to be operable with different types of radiators. Continuing with FIG. 7, the first adapter 600*a* has a unique identifier 800*a* of a letter C. The first cap 700*a* has a matching unique identifier 800*b* of a letter C to show the operational correlation between adapter 600*a* and cap 700*a*.

Figure 8A:
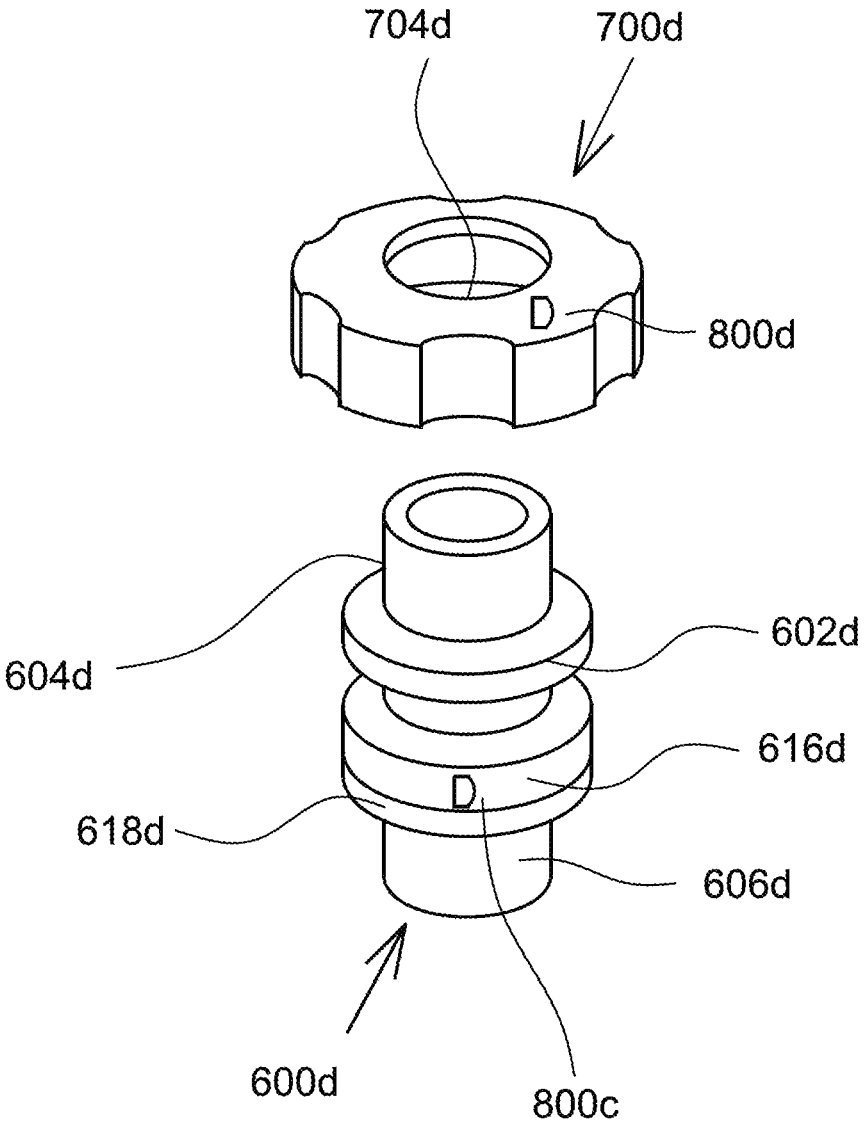
FIGS. 8A-8B illustrate close up views of exemplary two different adapters and a cap that is operational with both adapters, in accordance with an embodiment of the present invention.
Figure 8B:
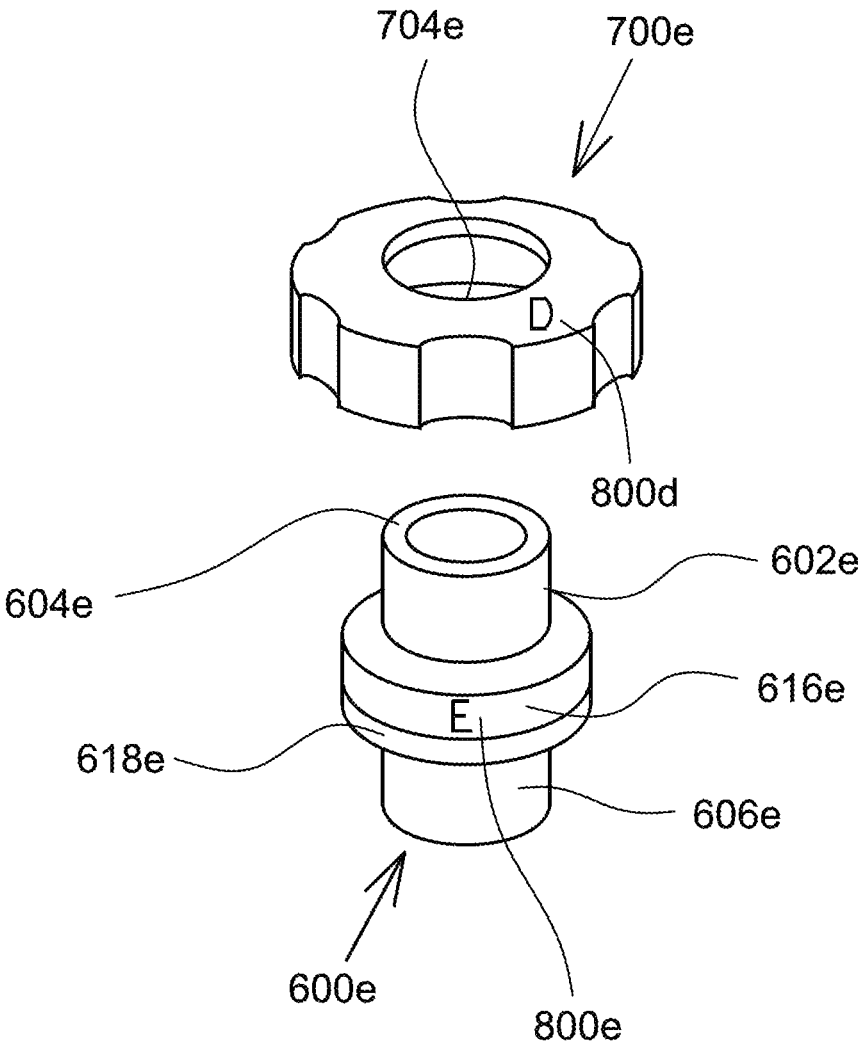
Figure 9A:
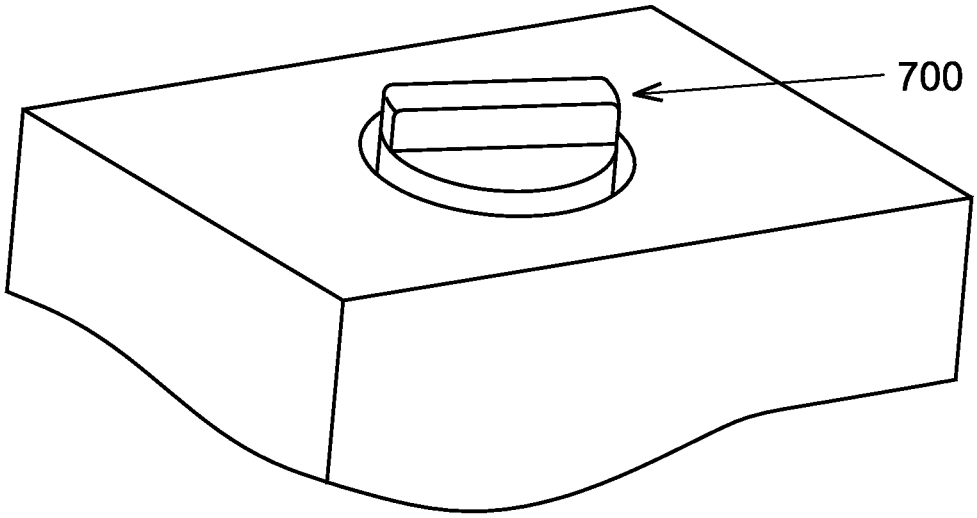
FIGS. 9A-9D illustrate a mechanism of installing the exemplary radiator funnel assembly with unique identifiers with a radiator, in accordance with an embodiment of the present invention.
Figure 9B:
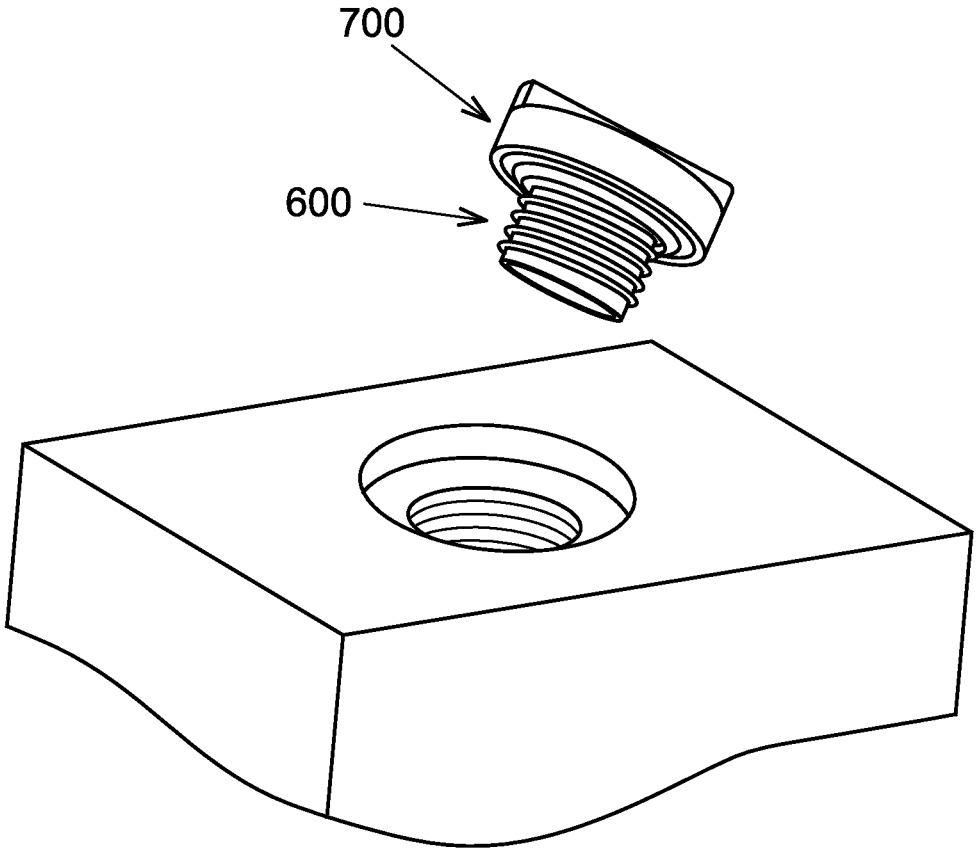
Figure 9C:
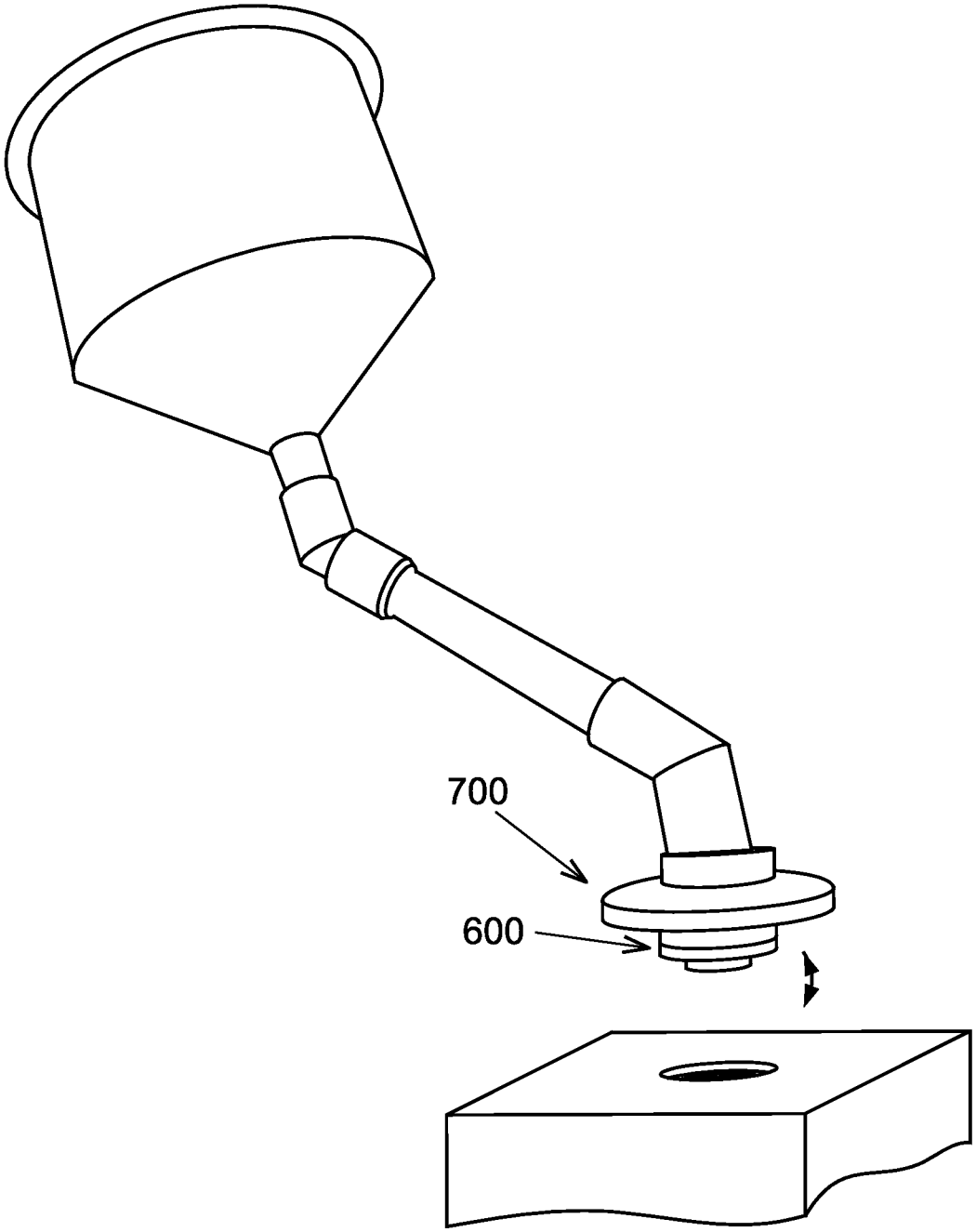
Figure 9D:
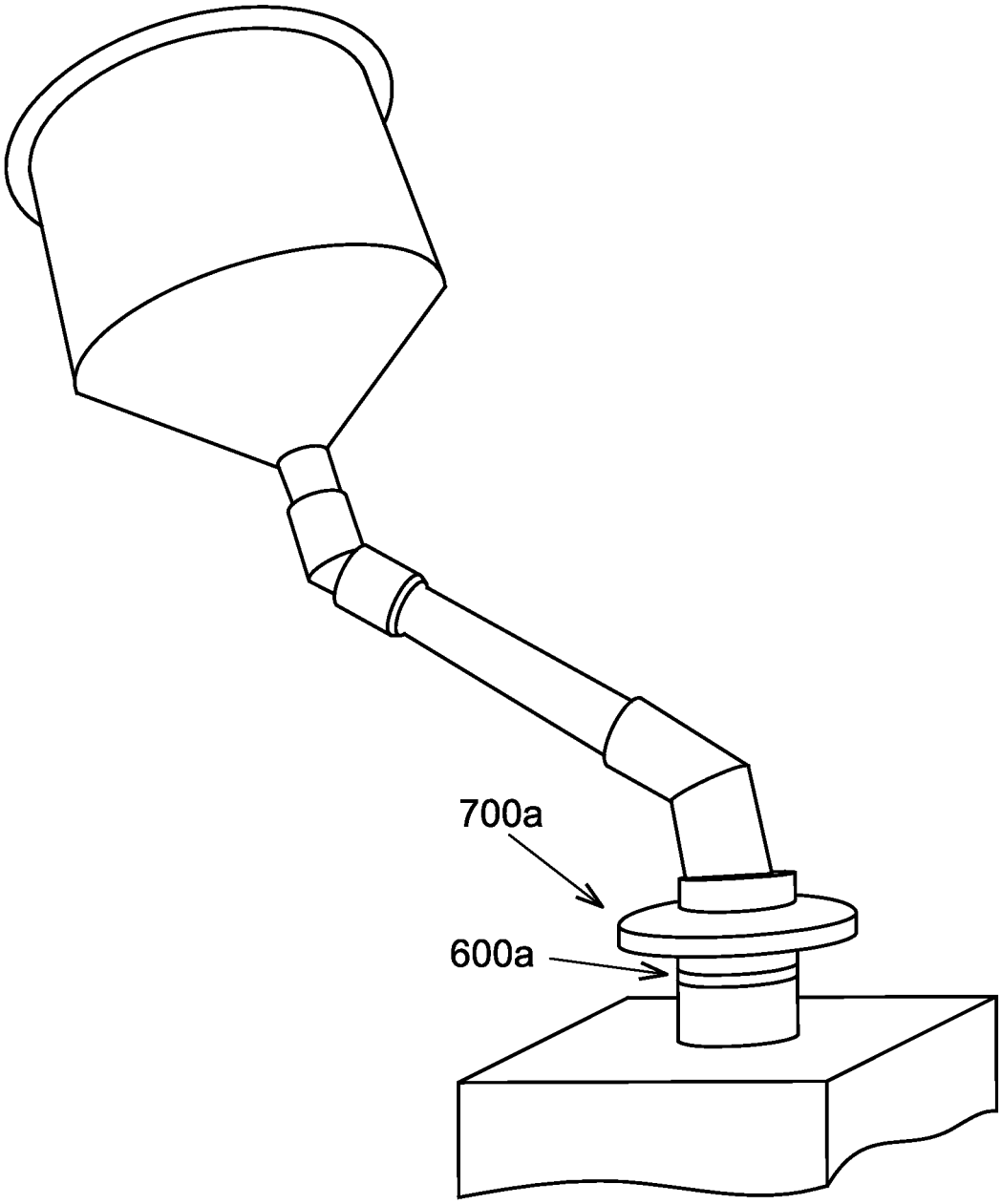

FIG. 8 illustrates a close up view of exemplary two different adapters 600*d*, 600*e* and a cap 700*d* that is operational with both adapters 600*d*, 600*e*. The first adapter 600*d* has a unique identifier 800*c* of a letter D. The second adapter 600*e* has a unique identifier 800*e* of a letter E. The cap 700*d* has a unique identifier 800*d* of a letter D. Further, both adapters 600*d*, 600*e* and the cap 700*d* are colored yellow to show the operational congruity therebetween.

Looking back at FIG. 5, the assembly 100 further comprises a plurality of caps 700*a-e* that are configured to fasten the adapters 600*a-e* to the radiator fill opening. The caps 700*a-e* are defined by a top cap face 702*a-e* and a hole 704*a-e* for receiving the tube 602*a-e*. The hole 704*a-e* may have different diameters and lengths for different caps 700*a-e*. The caps 700*a-e* may include a pair of fastening flanges 706*b*, 706*c* extending toward one another from opposite edges of the cap below the top cap face 702*a-e*. The fastening flanges 706*b*, 706*c* are configured to help secure the cap onto a circular lip portion defining the radiator fill opening.

Similar to adapters 600*a-e*, each cap 700*a-e* has a unique identifier 800*a-e*. The identifier 800*a-e*, as used with the caps, identifies a particular tube 602*a-e* to receive through the hole 704*a-e*. The unique identifier 800*a-e* of each cap 700*a-e* is further configured to identify a particular radiator fill opening at which the adapter. 600*a-e* is configured to detachably attach. This unique identification means enables identification and matching of the cap 700*a* with the matching adapter 600*a* and appropriate radiator fill opening. In this manner, the adapter 600*a* and cap 700*a* far a specific radiator is utilized: This may be useful for matching the adapters 600*a-e* and cam 700*a-e* to different types of radiators from different models and years of vehicles.

In one exemplary embodiment illustrated back in FIG. 5, a first adapter 600*a* has a unique identifier 800*a* of a blue color and a letter A. The blue, letter A identifier 800*a* may indicate an operational match with a cap 700 *a* and a Toyota® radiator 900*a*. A second adapter 600*b* has a unique identifier 800*b* of a red color and a letter B. The red, letter B identifier 800*b* may indicate an operational match with a cap 700*b* and a Hyundai® radiator 900*b*. A third adapter 600*c* has a unique identifier 800*c* of a green color and a letter C. The green, letter C identifier 800*c* may indicate an operational match with a cap 700*c* and a Chevrolet® radiator 900*c*.

Continuing with the exemplary embodiment, a fourth adapter 600*d* has a unique identifier 800*d* of a yellow color and a letter D. The yellow, letter D identifier 800*d* may indicate an operational match with a cap 700*d* and a Mercedes® radiator 900*d*. In one alternative embodiment, a fifth adapter 700*e* may be used with the same cap 700 of the fourth adapter 600*d*, but with a different variations in the radiator fill opening 901*e* for a specific model of Mercedes®. The fifth adapter 700 may have yet another unique identifier 800*e*. However, the adapters 600*a-e* and caps 700*a-d* may be used with any combination of identifier or type of radiator may be used in other embodiments.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A radiator funnel assembly comprising a funnel comprising:

a fluid receiving body comprising a side and a tapered bottom wall;

a spout comprising an inlet end and an outlet end, the inlet end of the spout is coupled to the tapered bottom wall of the fluid receiving body;

a first conduit comprising a first top end and a first bottom end, wherein the first top end is detachably coupled to the outlet end of the spout;

a second conduit comprising a second top end and a second bottom end, the second top end is detachably coupled to the first bottom end of the first conduit;

a third conduit comprising a third top end and a third bottom end, the third top end is detachably coupled to the second bottom end of the second conduit;

a plurality types of adapters, the third bottom end of the third conduit is detachably coupled to one adapter from the plurality types of adapters, wherein each type of adapter comprises:

a tube comprising a tube top end, a tube bottom end, an inner surface and an outer surface, wherein the tribe top end is detachably coupled to the third bottom end of the third conduit;

at least one annular sealing flange coupled to the outer surface of the tube;

a flexible seal coupled to the at least one annular sealing flange; and at least one tube identifier coupled to the at least one annular sealing flange or the tube; and a plurality types of caps coupled to the plurality types of adapters correspondingly, wherein each of the cap comprises a top cap face, a hole for receiving the tube, at least one cap identifier coupled to the top cap face, and A pair of fastening flanges extending from the top cap face, wherein, the at least one cap identifier is a color coded scheme or a labeling scheme, the radiator funnel assembly is assembled and disassembled by matching through the at least one cap identifier.

2. The radiator funnel assembly of claim 1, Wherein the at least one tube identifier from the plurality types of adapters is red and comprises a letter A, and the at least one cap identifier from the plurality types of caps is red and comprises another letter A.

3. The radiator funnel assembly of claim 1, wherein the at least one tube identifier from the plurality types of adapters is green and comprises a letter B, and the at least one cap identifier from the plurality types of caps is green and comprises another letter B.

4. The radiator funnel assembly of claim 1, wherein t at least one tube identifier from the plurality types of adapters is blue and comprises a letter C, and the at least one cap identifier from the plurality types of caps is blue and comprises another letter C.

5. The radiator funnel assembly of claim 1, wherein the at least one tube identifier from the plurality types of adapters is yellow and comprises a letter D, and the at least one cap identifier from the plurality types of caps is yellow and comprises another letter D.

6. The radiator funnel assembly of claim 1, wherein the funnel, the first conduit, the second conduit, and the third conduit are orange.

7. The radiator funnel assembly of claim 1, wherein the plurality of adapters are configured to be coupled to different types of radiator fill openings.

8. The radiator funnel assembly of claim 1, wherein the radiator funnel assembly comprises polymer, metal, aluminum, a metal alloy or a rubber.

9. The radiator funnel assembly of claim 1, wherein the flexible seal comprises an O-ring.

* * * * *